US009995262B2

(12) United States Patent
Grandi et al.

(10) Patent No.: US 9,995,262 B2
(45) Date of Patent: Jun. 12, 2018

(54) FLUID INJECTION VALVE

(71) Applicant: CONTINENTAL AUTOMOTIVE GMBH, Hannover (DE)

(72) Inventors: Mauro Grandi, Livorno (IT); Francesco Lenzi, Livorno (IT); Valerio Polidori, Livorno (IT); Stefano Filippi, Castel' Anselmo Collesalvetti (IT)

(73) Assignee: Continental Automotive GmbH, Hannover (DE)

( * ) Notice: Subject to any disclaimer, the term of this patent is extended or adjusted under 35 U.S.C. 154(b) by 68 days.

(21) Appl. No.: 15/023,511

(22) PCT Filed: Aug. 14, 2014

(86) PCT No.: PCT/EP2014/067437

§ 371 (c)(1),
(2) Date: Mar. 21, 2016

(87) PCT Pub. No.: WO2015/039821

PCT Pub. Date: Mar. 26, 2015

(65) Prior Publication Data

US 2016/0208750 A1 Jul. 21, 2016

(30) Foreign Application Priority Data

Sep. 20, 2013 (EP) ..... 13185365

(51) Int. Cl.
*F02M 51/06* (2006.01)
*F02M 61/04* (2006.01)

(52) U.S. Cl.
CPC ..... *F02M 51/0685* (2013.01); *F02M 51/066* (2013.01); *F02M 61/042* (2013.01)

(58) Field of Classification Search
CPC ..... F02M 51/0685; F02M 51/066; F02M 51/0664; F02M 61/042; F02M 51/0625; F02M 51/0667; F02M 61/12
USPC ..... 239/584–585.5, 533.2–533.12
See application file for complete search history.

(56) References Cited

U.S. PATENT DOCUMENTS

| | | | |
|---|---|---|---|
| 6,145,761 | A | 11/2000 | Mueller et al. |
| 7,007,870 | B2 | 3/2006 | Noller et al. |
| 7,252,245 | B2 | 8/2007 | Nishiwaki |
| 8,931,718 | B2 | 1/2015 | Grandi et al. |

(Continued)

FOREIGN PATENT DOCUMENTS

| | | |
|---|---|---|
| CN | 102667131 A | 9/2012 |
| DE | 102007000353 A1 | 1/2008 |

(Continued)

*Primary Examiner* — Alexander Valvis
*Assistant Examiner* — Juan C Barrera
(74) *Attorney, Agent, or Firm* — Laurence A. Greenberg; Werner H. Stemer; Ralph E. Locher

(57) ABSTRACT

A fluid injection valve has a valve needle and an electromagnetic actuator assembly with a pole piece and an armature. The valve needle includes a retainer element for limiting an axial displacement of the armature with respect to the valve needle in a first axial direction. The pole piece has a central opening with a step so that it has a first section in which a first portion of the retainer element is arranged and a second section for receiving a second portion of the retainer element. The first section of the central opening has a smaller cross-sectional area than the second section.

4 Claims, 1 Drawing Sheet

(56) References Cited

U.S. PATENT DOCUMENTS

| | | | | |
|---|---|---|---|---|
| 9,194,347 | B2 | 11/2015 | Graner et al. | |
| 2003/0168531 | A1 | 9/2003 | Maier | |
| 2004/0026541 | A1* | 2/2004 | Sebastian | F02M 51/0625 239/585.5 |
| 2007/0114299 | A1* | 5/2007 | Scheffel | F02M 51/0657 239/88 |
| 2011/0278368 | A1* | 11/2011 | Hornby | F02M 51/0671 239/5 |
| 2012/0286074 | A1* | 11/2012 | Soriani | F02M 51/0682 239/585.5 |
| 2012/0312903 | A1 | 12/2012 | Grandi | |
| 2013/0221138 | A1 | 8/2013 | Rogler | |

FOREIGN PATENT DOCUMENTS

| | | | |
|---|---|---|---|
| EP | 1337752 | A2 | 8/2003 |
| EP | 1602821 | A1 | 12/2005 |
| EP | 2218900 | A1 | 8/2010 |
| EP | 2282042 | A1 | 2/2011 |
| EP | 2333297 | A1 | 6/2011 |
| EP | 2385239 | A1 | 11/2011 |
| EP | 2634412 | A1 | 9/2013 |
| JP | 3845963 | B2 | 11/2006 |
| JP | 2008106781 | A | 5/2008 |
| JP | 2013160213 | A | 8/2013 |
| KR | 20120138710 | A | 12/2012 |
| WO | 03072928 | A1 | 9/2003 |

* cited by examiner

FLUID INJECTION VALVE

BACKGROUND OF THE INVENTION

Field of the Invention

The present disclosure relates to a fluid injection valve, in particular for an internal combustion engine.

Fluid injection valves can be used for dosing fuel into a combustion chamber of an internal combustion engine, for example. They may have a valve needle for sealing and unsealing an injection opening of the fluid injection valve. The valve needle may be actuated by an electromagnetic actuator assembly which comprises an armature.

For example, EP 2333297 A1 discloses an injection valve having an armature which is coupled to the valve needle via springs. The movability of the valve needle and the armature relative to each other may be related to uncontrollable needle movements during the opening phase of the injection valve.

EP 2634412 A1 discloses an injection valve which comprises a housing with an injection opening, an internal pole which is location fixed with respect to the housing, a solenoid which acts magnetically on the internal pole, and a magnetic armature which is linearly movable relative to the housing. A valve needle is linearly movable relative to the housing and against the magnetic armature and forms a valve seat together with the housing. A first stop surface is formed location fixed relative to the housing on the internal pole. A second stop surface is formed on the valve needle. In an end position of the valve needle at maximum needle lift, the second stop surface abuts the first stop surface.

BRIEF SUMMARY OF THE INVENTION

Therefore, it is an object of the present invention to specify a fluid injection valve which facilitates a reliable and precise function.

This object is achieved by a fluid injection valve having the features as claimed. Advantageous embodiments and developments of the fluid injection valve are specified in the dependent claims, the following description and the figures.

A fluid injection valve is specified. The fluid injection valve comprises a valve body. The valve body has a central longitudinal axis. It defines a cavity which hydraulically couples the fluid inlet portion of the fluid injection valve with the fluid outlet portion of the fluid injection valve. In particular, the cavity extends through the valve body from the fluid inlet portion to the fluid outlet portion.

The fluid injection valve further comprises a valve needle. The valve needle is arranged in the cavity. It is operable to seal the fluid outlet portion in a closing position. The valve needle is axially displaceable in a first axial direction with respect to the valve body for unsealing the fluid outlet portion. In case of an inward opening valve, the first direction is directed from the fluid outlet portion towards the fluid inlet portion. In particular, the valve needle has a needle tip which interacts with a valve seat for sealing and unsealing the fluid outlet portion, in particular to control a fluid flow through one or more injection openings of the fluid injection valve.

The fluid injection valve further comprises an electromagnetic actuator assembly. The electromagnetic actuator assembly comprises a pole piece and an armature. The pole piece is positionally fixed with respect to the valve body. The armature is arranged in the cavity and axially displaceable with respect to the pole piece and with respect to the valve needle. The armature is in particular attracted by the pole piece when the actuator assembly is energized, so that it may conveniently move towards the pole piece in the first axial direction. The axial displacement of the armature with respect to the pole piece is in particular limited by means of the armature coming in mechanical contact with the pole piece. The pole piece and the valve needle are preferably configured such that the valve needle is axially displaceable relative to the armature while the armature mechanically contacts the pole piece.

The valve needle comprises a retainer element. The retainer element is operable to interact with the armature for limiting axial displacement of the armature with respect to the valve needle in the first axial direction. In particular, the retainer element limits the axial displacement of the armature with respect to the valve needle by means of direct mechanical contact. The retainer element is operable to contact the pole piece for limiting axial displacement of the valve needle with respect to the pole piece in the first axial direction. According to one embodiment, the retainer element is in the shape of a collar extending circumferentially around the shaft of the valve needle.

In this way, during the opening transient of the fluid injection valve, the travel of the needle, which continues after the armature has come into contact with the pole piece, may be stopped by the retainer element interacting with the pole piece. In this way, the travel of the needle with respect to the armature can be stopped particularly fast and can be controlled particularly well. In this way, the opening transient of the fluid injection valve may have a particularly high repeatability. The performance of the fluid injection valve may be particularly stable and particular small fluid doses may be injectable.

According to one embodiment, the valve needle further comprises a disc element. The disc element is configured for limiting axial displacement of the armature with respect to the valve needle in a second axial direction, opposite the first axial direction. The disc element is in particular positioned on the side of the armature which faces away from the retainer element. To put it in another way, the armature is positioned axially between the retainer element and the disc element so that it has a given play allowing axial movement of the armature with respect to the valve needle between the retainer element and the disc element.

The disc element is positioned such that it is spaced apart from the armature when the armature and the retainer element both are in mechanical contact with the pole piece for limiting the axial displacement of the valve needle and the armature, respectively, in the first axial direction. To put it in another way, when the armature is in mechanical contact with the pole piece so that the pole piece blocks movement of the armature in the first axial direction with respect to the pole piece and the retainer element is in mechanical contact with the armature so that the armature blocks movement of the valve needle in the second axial direction, there is a residual axial gap between the retainer element and the pole piece having a first height and there is a further residual axial gap between the disc element and the armature having a second height, the second height being larger than the first height. The heights of the residual axial gaps are in particular defined by a respective distance which the valve needle can travel in the first axial direction before—in case of the first height—the pole piece or—in case of the second height—the armature block further movement of the valve needle relative to the pole piece or the armature, respectively, absent other elements of the fluid injection valve which may interfere with the displacement of the valve needle.

In this way, a fluid gap remains between the armature and the disc element when the retainer element hits the pole piece. This may advantageously avoid sticking of the disc element of the valve needle to the armature which may slow down the movement of the valve needle in the second axial direction. Thus, the retainer element may disengage from the pole piece particularly quickly.

According to one embodiment, the retainer element has a first portion which extends into a central opening of the pole piece for axially guiding the valve needle. Preferably, the retainer element has a second portion which protrudes radially beyond the first portion. According to one embodiment, the central opening of the pole piece has a step. By means of the step, a first section of the central opening is defined in which the first portion of the retainer element is arranged and a second section of the central opening is defined which is configured for receiving the second portion of the retainer element. The first section has a smaller cross-sectional area than the second section. The second portion of the retainer element may expediently project radially beyond the first section of the central opening of the pole piece. With advantage, the step may be operable to limit the axial displacement of the valve needle in the first axial direction with respect to the pole piece in this way.

Preferably, the retainer element is operable to limit axial displacement of the valve needle with respect to the pole piece in the first axial direction by means of a form-fit engagement between the second portion of the retainer element and the step of the central opening. The form-fit engagement of the second portion of the retainer element with the pole piece may be established with a surface of the second portion which faces away from the armature. The retainer element is preferably also configured for limiting axial displacement of the armature relative to the valve needle in the first axial direction by a form-fit engagement between the second portion and the armature. Thus, a particularly cost-efficient realisation of the axial displacement limiting is achievable.

Further advantages and advantageous embodiments and developments of the fluid injection valve will become apparent from the exemplary embodiment which is described below in association with the figures.

DESCRIPTION OF THE INVENTION

In the exemplary embodiments and figures, identical, similar or similarly acting constituent parts are provided with the same reference symbols.

Figure 1:
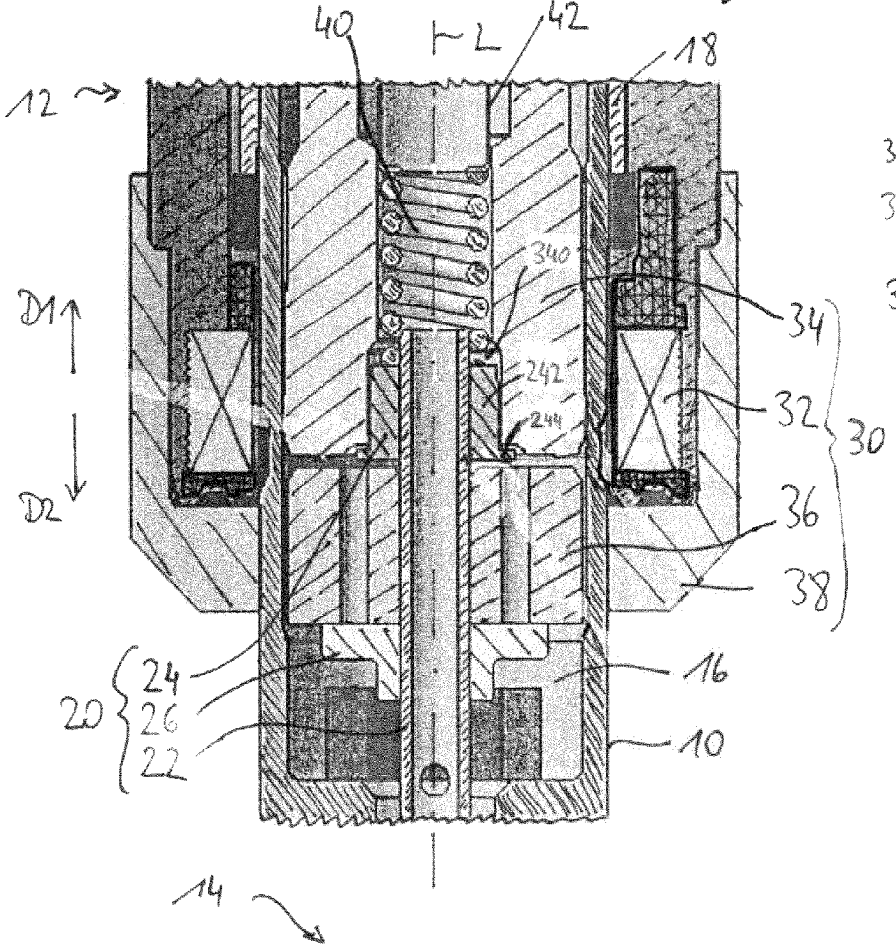
FIG. 1 shows a longitudinal section view of a portion of a fluid injection valve according to an exemplary embodiment in a closed configuration.

FIG. 1 shows a portion of the fluid injection valve 1 in a closed configuration in a longitudinal section view.

The fluid injection valve 1 comprises a valve body 10. The valve body 10 has a longitudinal axis L. The valve body 10 defines a cavity 16 which extends along the longitudinal axis L and hydraulically couples a fluid inlet portion 12 with a fluid outlet portion 14 of the fluid injection valve 1. In the present embodiment, the fluid injection valve 1 further comprises an inlet tube 18 which extends the valve body 10 in longitudinal direction L towards the fluid inlet portion 12.

A valve needle 20 is arranged in the cavity 16. In a closing position, the valve needle 20 is operable to seal the fluid outlet portion 14. Specifically, in the closing position, a needle tip of the valve needle 20 rests on a valve seat (not shown in the figures). Preferably, the valve seat is comprised by a seat element (not shown) which is fixed to the valve body 10 at the fluid outlet portion 14. The seat element preferably comprises one or more injection holes (not shown) through which the fluid injection valve 1 is operable to dispense fluid such as fuel to the outside, in particular into a combustion chamber of an internal combustion engine.

The fluid injection valve one 1 further comprises a return spring 40 for biasing the valve needle 20 towards the closing position. The valve needle 20 is axially displaceable in a first axial direction D1 with respect to the valve body 10 for unsealing the fluid outlet portion 14 against the bias of the return spring 40. Specifically, when the valve needle 20 is moved away from the closing position in the first axial direction D1, the needle tip moves away from the valve seat so that the fluid outlet portion 14 is unsealed and the fluid injection valve 1 dispenses fluid through the injection hole or injection holes.

Further, the fluid injection valve 1 comprises an electromagnetic actuator assembly 30. The actuator assembly 13 comprises a coil 32, a pole piece 34, an armature 36, and a housing 38. The pole piece 34 is received in the cavity 16 of the valve body 10. It is positionally fixed with respect to the valve body 10, for example by means of a friction fit. The coil 32 extends circumferentially around the valve body 10 and the pole piece 34. It is arranged in the housing 38 which may represent a yoke of the electromagnetic actuator assembly 30.

The armature 36 is arranged in the cavity 16. It is axially displaceable in reciprocating fashion with respect to the pole piece 34—and thus also with respect to the valve body 10 which is positionally fix relative to the pole piece 34—and with respect to the valve needle 20. Specifically, the armature 36 extends circumferentially around a needle shaft 22 of the valve needle 20. In other words, the needle shaft 22 extends axially through a central opening of the armature 36.

The valve needle 20 comprises a retainer element 24 which is operable to interact with the armature 36 to limit axial displacement of the armature 36 with respect to the valve needle 20 in the first axial direction D1. In the present embodiment, the retainer element 24 is a separately manufactured part that is fixed to the needle shaft 22 at an end of the needle shaft 22 facing towards the fluid inlet portion 12. Preferably, the retainer element 24 is in the shape of a collar extending around the needle shaft 22. In an alternative embodiment, the retainer element 24 is a collar which is in one piece with the needle shaft 22.

Expediently, the retainer element 24 represents also a spring seat for the return spring 40. As a second spring seat for the return spring 40, the fluid injection valve 1 may comprise a calibration tube 42 which, in the present embodiment, is fixed to the pole piece 34 by a friction fit. A fuel filter (not shown in the figures) may be comprised by the calibration tube 42.

The armature 36 is operable to take the valve needle 20 with it in the first axial direction D1 by means of a form fit engagement with a downstream surface of the retainer element 24. In this way, the electromagnetic actuator assembly 13 is operable to displace the valve needle 20 away from the closing position.

The retainer element 24 is received in a central opening 340 of the pole piece 34. More specifically, the retainer element 24 has a first portion 242 and a second portion 244. The second portion 244 faces towards the armature 36 and the first portion 242 is arranged subsequent to the second portion 244 in axial direction away from the armature 36. The downstream surface of the retainer element 24 is comprised by its second portion 244 in the present embodiment. The central opening 340 of the pole piece 34 has a step 346 which divides the central opening 314 axially into a first section 342 and a second section 344. The second section 344 of the central opening 340 faces towards the armature 36 and the first section 342 is arranged axially subsequent to the second section 344 in a direction away from the armature 36. The first portion 242 of the retainer element 24 is arranged in the first section 342 of the central opening 340 of the pole piece 34 for axially guiding the valve needle 20.

The second portion 244 of the retainer element 24 protrudes radially beyond the first portion 242 of the retainer element 24 and also radially beyond the first section 342 of the central opening 340 of the pole piece 34. The second section 344 is configured for receiving the second portion 244 of the retainer element 24. Therefore, the second section 344 has a larger cross-section area than the first section 342. The step 346 may be present a bottom surface of the second section 344. The second portion 244 overlaps the bottom surface of the second section 344 in top view along the longitudinal axis L.

The pole piece 34 and the valve needle 20 are configured such that the valve needle 20 is axially displaceable relative to the armature 36 while the armature 36 mechanically contacts the pole piece 34.

Figure 2:
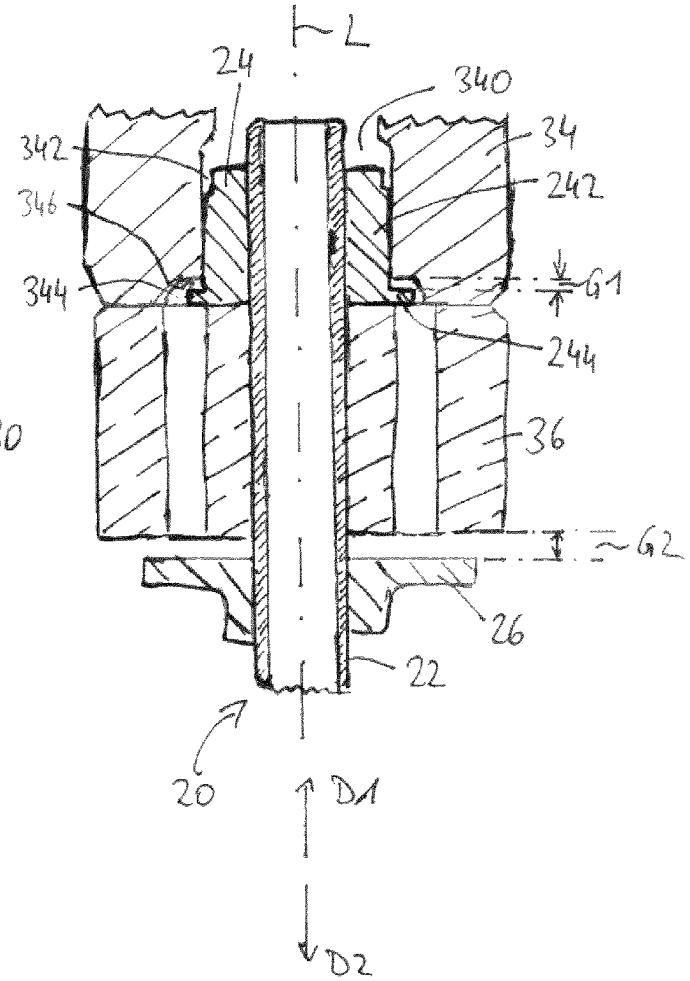
FIG. 2 shows a longitudinal section view of the fluid injection valve of FIG. 1 in an opened configuration.

This is shown in further detail in the longitudinal section view of FIG. 2. FIG. 2 shows the valve needle 20, the pole piece 34 and the armature 36 of FIG. 1 in an opened configuration of the fluid injection valve 1, where the armature 36 is in direct mechanical contact with the pole piece 34. Further elements of the fluid injection valve 1 are omitted in FIG. 2 for the sake of better representability and/or understanding.

In this configuration, the armature 36 has displaced the valve needle 20 in the first axial direction D1 away from the closing position by mechanical interaction with the second portion 244 of the retainer element 24. The force of the return spring 14 presses the downstream surface of the second portion 244 of the retainer element 24 against the armature 36.

In the present embodiment, the second portion 244 of the retainer element 24 is positioned completely with in the second section 344 of the central opening 340 of the pole piece 34. The step 346 is positioned such that there is residual axial gap G1 between the step 346 and an upstream surface of the second portion 244 of the retainer element 24. By means of the residual axial gap G1, the valve needle may 20 move out of contact with the armature 36 towards the step 346 of the central opening 340 of the pole piece 34. The retainer element 24—specifically upstream surface of the second portion 244 of the retainer element 24—is operable to contact the pole piece 34—specifically the step 346 of the pole piece 34—for limiting axial displacement of the valve needle 20 with respect to the pole piece 34 in the first axial direction D1. In particular, axial displacement of the valve needle 20 with respect to the pole piece 34—and thus with respect to the valve body 10—is limited by means of a form fit engagement between the upstream surface of the second portion 244 of the retainer element 24 and the step 346 of the pole piece 34.

The valve needle 20 further comprises a disc element 26 which is fixed to the needle shaft 22 on the side of the armature 36 which faces away from the retainer element 24. The retainer element 24 and the disc element 26 are positioned on the needle shaft 22 in such fashion that the armature 36 has a given axial play so that it can move axially along the needle shaft 22 in reciprocating fashion between the retainer element 24 and the disc element 26. The disc element 26 is operable to limit axial displacement of the armature 36 with respect to the valve needle 20 in a second axial direction D2 which is opposite to the first axial direction D1.

The disc element 26 is positioned such that it is spaced apart from the armature 36 and the armature 36 and the retainer element 24 both are in mechanical contact with the pole piece 34 for limiting the axial displacement of the valve needle 20 and the armature 36, respectively, in the first axial direction D1. In other words, when the armature 36 abuts the pole piece 34 and the retainer element 24 abuts the armature 36 so that there is the residual axial gap G1 between the step 346 of the pole piece 34 and the second portion 244 of the retainer element 24, there is a further residual axial gap G2 between the armature 36 and the disc element 26. The height of the further residual axial gap G2 is larger than the height of the residual axial gap G1.

In the following, the function of the fluid injection valve 1 according to the present embodiment is described in further detail.

Starting from the closed configuration of FIG. 1, the actuator assembly 30 is energized by feeding a current into the coil 32, so that the latter generates a magnetic field. By means of the generated magnetic field, the pole piece 34 effects the armature 36 in the first axial direction D1. The armature moves in the first axial direction D1 with respect to the valve body 10 and with respect to the valve needle 20 until it comes into contact with the retainer element 24. On its further travel in the first axial direction D1, the armature 36 takes the valve needle 20 with it against the bias of the return spring 40 by means of the form fit connection with the retainer element 24.

The axial travel of the armature 36 in the first axial direction D1 is stopped when the armature 36 comes into contact with the pole piece 34. However, this does not stop the travel of the valve needle 20 in the first axial direction D1. Rather, the valve needle 20 continues its travel in that direction due to its inertia against the bias of the return spring 40. The residual axial gap G1 is dimensioned such that it stops the axial travel of the valve needle 20 in the first axial direction D1 with respect to the armature 36 and the valve body 10 before the kinetic energy of the valve needle 20 is completely dissipated and/or converted into potential energy of the return spring 40. In other words, absent the form fit connection between the step 346 of the pole piece 34 and the second portion 244 of the retainer element 24, the valve needle would travel a larger distance away from the armature 36 then the distance defined by the height of the residual axial gap G1.

Subsequently, the return spring 40 forces the valve needle 20 to move back in the second axial direction D2 until the retainer element 24 comes into contact with the armature 36, again. In this opened configuration, fluids—in particular fuel—may be dispensed through the one or more injection holes of the fluid injection valve 1.

When the actuator assembly 30 is deenergized, the pole piece 34 does no longer attract the armature 36 and the return spring 14 forces the valve needle 20 to move in the second axial direction D2 back into the closing position. By means of the form fit engagement between the retainer element 24 and the armature 36, the valve needle 20 takes armature 36 with it in the second axial direction D2.

When the needle tip of the valve needle 20 hits the valve seat, the travel of the valve needle 20 in the second axial direction D2 is stopped. The armature 36 decouples from the retainer element 24 due to its inertia and travels further in the second axial direction D2 with respect to the valve body 10 and the valve needle 20 towards the disc element 26.

The movement of the armature 36 may be damped, for example by means of hydraulic damping due to interaction with the disc element 26, so that the armature 36 finally comes to a rest adjacent to the disc element 26. The fluid injection valve 1 may also comprise an elastic member for biasing the armature 36 of away from the retainer element 24 and towards the disc element 26.

The invention is not limited to specific embodiments by the description on the basis of said exemplary embodiments.

For example, the fluid injection valve 1 may comprise an elastic member which biases the armature into contact with the retainer element 24. In this case, the armature may abut the retainer element 24 in the closed configuration of the fluid injection valve 1. The elastic member may force the armature 36 to return in the first axial direction D1 until it comes into contact with the retainer element 24 in the closed configuration of the fluid injection valve 1, subsequent of the decoupling of the armature 36 from the retainer element 24 and its travel in the second axial direction D2 relative to the valve needle 20 during the closing transient.

It is also conceivable, for example, that the second portion 244 of the retainer element 24 is not received in the central opening 340 of the pole piece 34, but, for example, in a recess of the armature 36.

The invention claimed is:

1. A fluid injection valve, comprising:

a valve body having a central longitudinal axis and defining a cavity which hydraulically couples a fluid inlet portion with a fluid outlet portion of the fluid injection valve;

a valve needle arranged in said cavity, said valve needle having a needle shaft and being operable to seal said fluid outlet portion in a closing position and being axially displaceable in a first axial direction with respect to said valve body for unsealing said fluid outlet portion; and an electromagnetic actuator assembly having a pole piece and an armature, said pole piece located inside said cavity defined by said valve body and being positionally fixed with respect to said valve body, said armature being arranged in said cavity and being axially displaceable relative to said pole piece and relative to said valve needle;

said valve needle having a retainer element operable to interact with said armature to limit an axial displacement of said armature relative to said valve needle in the first axial direction, and said retainer element being operable to contact said pole piece for limiting an axial displacement of said valve needle relative to said pole piece in the first axial direction;

said retainer element being a collar extending circumferentially around said needle shaft of said valve needle;

said retainer element having a first portion which extends into a central opening of said pole piece for axially guiding said valve needle, and a second portion which protrudes radially beyond said first portion;

said central opening of said pole piece having a step forming a first section in which said first portion of said retainer element is arranged and a second section for receiving said second portion of said retainer element, said first section having a smaller cross-sectional area than said second section; and said second portion of said retainer element being positionally fixed with respect to said valve needle.

2. The fluid injection valve according to claim 1, wherein said pole piece and said valve needle are configured such that said valve needle is axially displaceable relative to said armature while said armature mechanically contacts said pole piece.

3. The fluid injection valve according to claim 1, wherein said valve needle further comprises a disc element for limiting an axial displacement of said armature with respect to said valve needle in a second axial direction, opposite the first axial direction, said disc element being positioned spaced apart from said armature when said armature and said retainer element both are in mechanical contact with said pole piece for limiting the axial displacement of said valve needle and said armature, respectively, in the first axial direction.

4. The fluid injection valve according to claim 1, wherein said retainer element is operable to limit the axial displacement of said valve needle with respect to said pole piece in the first axial direction by way of a form-fit engagement between said second portion of said retainer element and said step.

* * * * *